United States Patent [19]

Obata et al.

[11] 4,266,291

[45] May 5, 1981

[54] ELECTROMAGNETIC SWING DEVICE

[75] Inventors: Katsuhiro Obata, Iida; Shigenobu Koizumi, Matsukawa, both of Japan

[73] Assignee: Iida Sankyo Co., Ltd., Iida, Japan

[21] Appl. No.: 972,175

[22] Filed: Dec. 21, 1978

[30] Foreign Application Priority Data

Dec. 27, 1977 [JP] Japan ..... 52-156573
Dec. 27, 1977 [JP] Japan ..... 52-156574

[51] Int. Cl.[3] ..... G04B 17/00

[52] U.S. Cl. ..... 368/168; 368/160; 368/157; 368/76

[58] Field of Search ..... 58/23 D, 23 TF, 23 R, 58/23 V, 28 R, 28 A, 28 B, 28 D, 85.5; 318/119, 126, 129, 131; 310/36, 37; 368/168, 160, 157, 76, 158, 161, 162, 163, 169, 185

[56] References Cited

U.S. PATENT DOCUMENTS

| | | | |
|---|---|---|---|
| 2,949,571 | 8/1960 | Gerhard | 318/131 |
| 3,129,554 | 4/1964 | Yasukawa | 58/23 TF |
| 3,134,062 | 5/1964 | Held | 58/28 A X |
| 3,435,311 | 3/1969 | Matsuzawa et al. | 310/37 X |
| 3,597,634 | 8/1971 | Flaig | 58/28 X |
| 3,691,753 | 9/1972 | Kurita | 58/85.5 X |
| 3,711,754 | 1/1973 | Nemoto | 318/126 |
| 3,737,746 | 6/1973 | Cielaszyk et al. | 310/37 X |
| 3,766,729 | 10/1973 | Diersbock | 310/36 X |

*Primary Examiner*—Ulysses Weldon
*Attorney, Agent, or Firm*—Sughrue, Rothwell, Mion, Zinn and Macpeak

[57] ABSTRACT

An electrical swing mechanism having a drive device with a rotor and a stator. The drive device carries out self-returning reciprocation with a rotation angle of the rotor. An intermittent drive transmission device transmits the rotation of the drive device to a utilization mechanism. An electric source unit is used for exciting the stator with a pulse current. The drive device has a rotor which is magnetized so that the same poles are formed on a diametral line intersecting the rotation axis thereof and a magnetization angle between different poles is 2 $\alpha$, and a stator whose magnetic pole angle $\beta$ is larger than said magnetization angle 2 $\alpha$. The intermittent drive transmission device comprises a cut disk member having a ratchet pawl and is reciprocated by the drive device. A ratchet plate member having ratchet teeth are moved one pitch by one pitch by the ratchet pawl. The reset mechanism comprises a release lever for disengaging the ratchet pawl from the ratchet teeth and a correcting gear for turning the release lever.

15 Claims, 16 Drawing Figures

ELECTROMAGNETIC SWING DEVICE

BACKGROUND OF THE INVENTION

This invention relates to an electrical time piece employing a novel drive device.

Heretofore, motor driven time pieces have employed rotary motors such as synchronous motors and step motors, plungers based on electromagnetic force, transistor driven balance-wheels, and tuning fork type motors. Variations of all these types have been put into practical use. Furthermore, conventional motor driven time pieces can be divided into a group of time pieces in which commercial A.C. electric source current is employed as the electric source of the drive source, and a group of time pieces in which a battery or an automobile battery is used to provide AC or DC pulses by means of crystal oscillators.

The time piece employing the rotary motor as its driving source is disadvantageous in that the power consumption is relatively large, as the rotor rotates at high speed. Hence, a number of gear trains are required, and therefore the driving source is necessarily bulky. Furthermore, the time piece employing the step motor driven by the DC pulses is also disadvantageous in that an expensive magnet must be used as the rotor. Also the dimensions of the rotor must be highly accurate. In the time piece that uses a plunger, a transistor driven balance-wheel, or a tuning fork type motor, the rotor is displaced a predetermined distance from its stationary position upon application of current. It is restored by suspending the application of current, this one cycle of operation being utilized as its driving source. In this case, the restoring operation is effected by an elastic force of a hair spring, an ordinary spring or the like. Accordingly, in the case where such a conventional time piece is mounted on an automobile, the spring is bent by vibration. Therefore, it is not suitable to use the conventional time piece at a place where large vibrations often occur. In addition, when the rotor is turned, the electromagnetomotive force acts against the elastic force of the spring, and therefore the electromagnetomotive force must be much stronger than normally required merely for rotating the rotor.

SUMMARY OF THE INVENTION

This invention relates to a novel drive device in which all of the above-described difficulties have been eliminated. This invention is intended to provide an electrical time piece employing this novel drive device.

Accordingly it is an object of this invention to provide a drive device in an electrical time piece that is reliable an inexpensive.

It is another object of this invention to provide a drive device in an electrical time piece that has low power requirements.

Still another object of this invention is to provide a drive device in an electrical time piece that is rugged and suitable for a variety of different uses.

These and other objects of this invention are attained by an electrical time piece having a drive device with a rotor and a stator. The drive device carries out self-returning reciprocation with a rotation angle of the rotor. An intermittent drive transmission device transmits the rotation of the drive device to a time piece mechanism. An electric source unit is used for exciting the stator with a pulse current. The drive device has a rotor which is magnetized so that the same poles are formed on a diametral line intersecting the rotation axis thereof and a magnetization angle between different poles is $2\alpha$, and a stator whose magnetic pole angle $\beta$ is larger than said magnetization angle $2\alpha$. The intermittent drive transmission device comprises a cut disk member having a ratchet pawl and is reciprocated by the drive device. A ratchet plate member having ratchet teeth are moved one pitch by one pitch by the ratchet pawl.

This invention will be described with reference to its preferred embodiment shown in the accompanying drawings.

BRIEF DESCRIPTION OF THE DRAWINGS

The accompanying drawings show one example of an electrical time piece according to the invention.

DESCRIPTION OF THE PREFERRED EMBODIMENT

Figure 1:
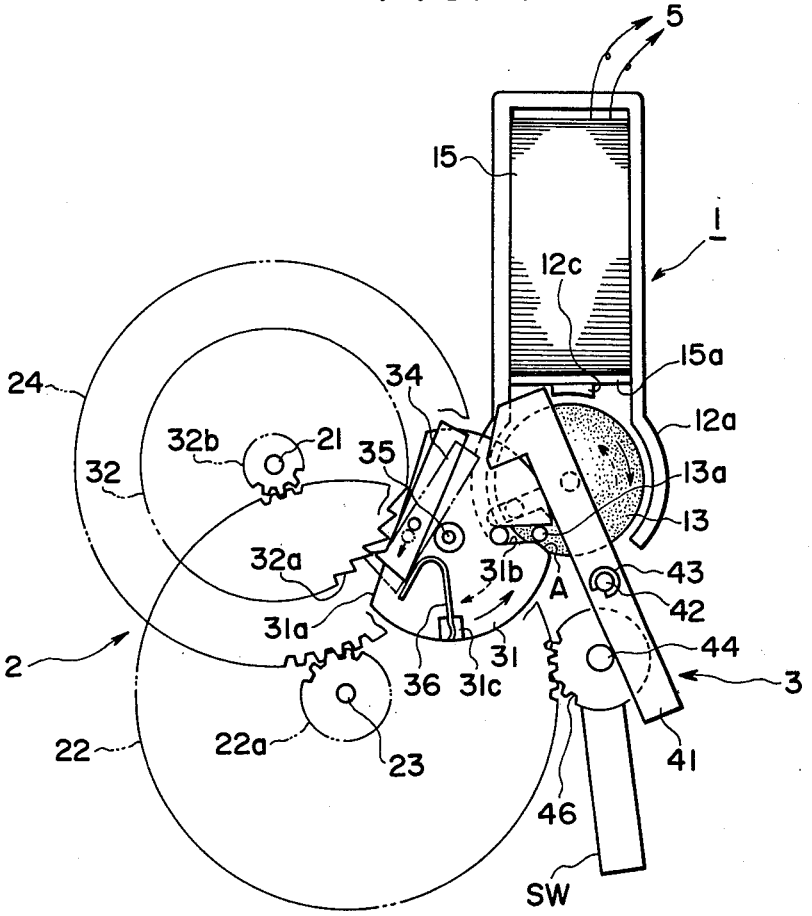
FIG. 1 is a front view of the interior of the electrical time piece.
Figure 2:
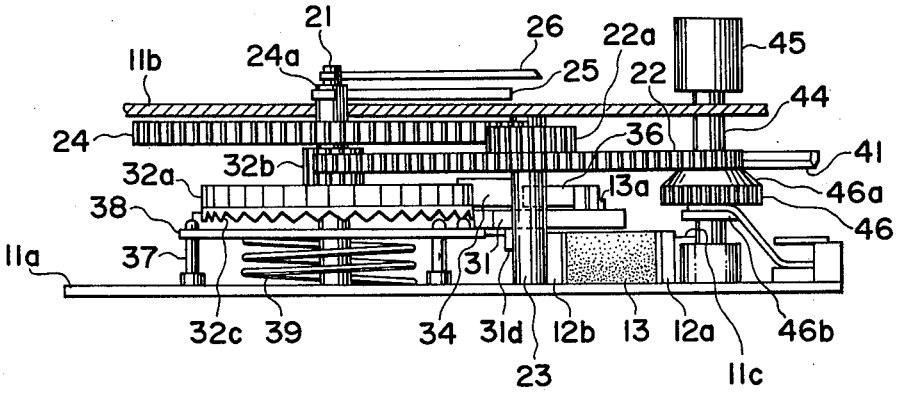
FIG. 2 is a side view of the electrical time piece shown in FIG. 1.
Figure 3:
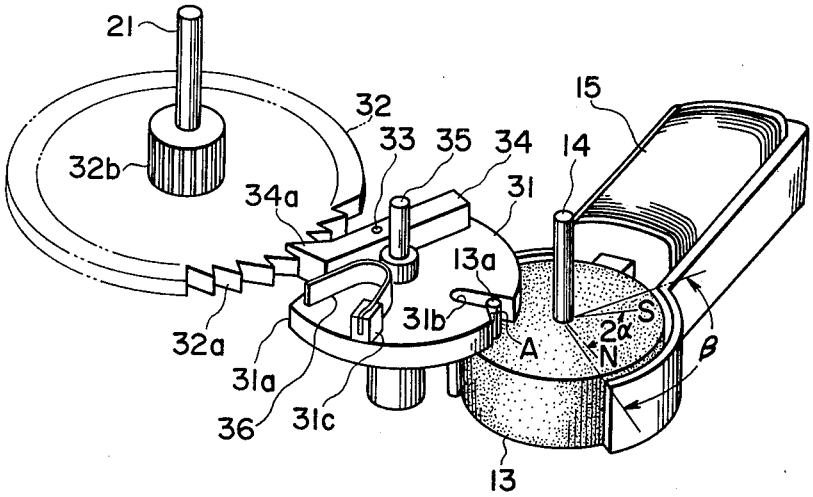
FIG. 3 is a perspective view showing the essential parts of the electrical time piece.

FIGS. 1 through 3 show an analog type electrical time piece according to the invention, which comprises a drive device 1 having a novel arrangement. An intermittent drive transmission device 3 transmits the rotation of the drive device 1 to a time piece mechanism 2 and a reset mechanism of the time piece mechanism 2. An electric source unit 5 supplies current to the drive device 1.

Figure 4:
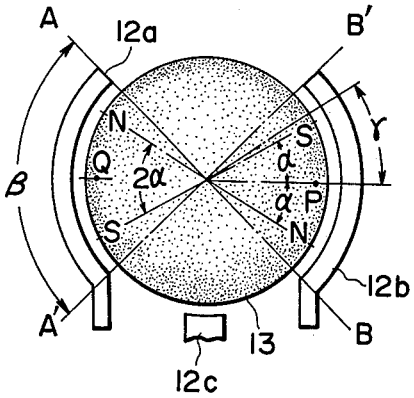
FIG. 4 is a diagram indicating the angular relations between the magnetic poles of a stator, and a rotor.
Figure 5A:
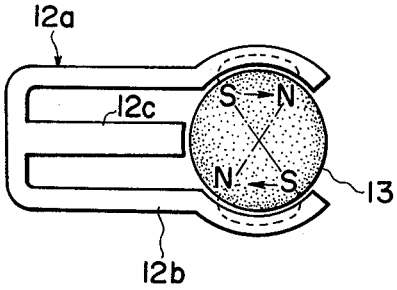
FIGS. 5*a*, 5*b*, 5*c*, and 5*d* are diagrams for a description of the operating principle of a drive device employed in the electrical time piece.
Figure 5C:
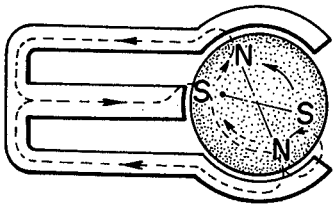
Figure 5B:
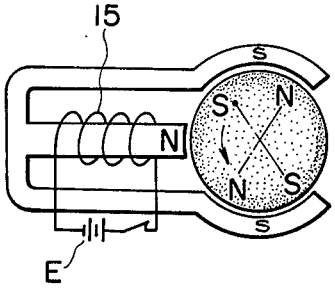
Figure 5D:
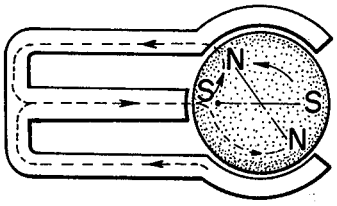
Figure 6:
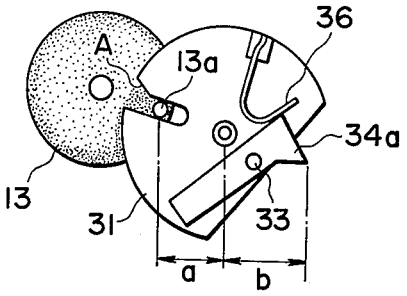
FIGS. 6 and 7 are explanatory diagrams showing a cut disk member.
Figure 9:
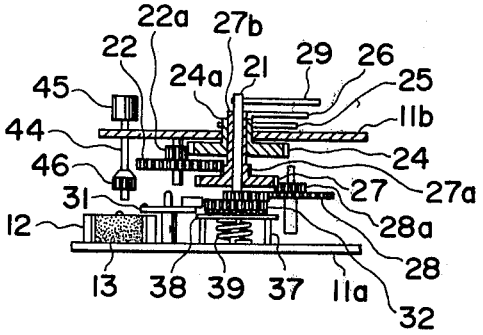
FIG. 9 is a side view of a time piece having a second hand.

In the drive device 1, as shown in FIGS. 1, 4 and 5, a stator 12 (FIG. 5) is mounted on a substrate 11*a* by securing a fixing part 11*c* of the stator 12 to the substrate 11*a*. A rotor 13 is disposed between the magnetic poles 12*a* and 12*b* of the stator 12. The rotary shaft of the rotor 13 is supported by bearings provided on a lower substrate 11*a* (FIG. 9).

The stator 12 is a substantially U-shaped plate both end portions of which are curved to form the magnetic poles 12*a* and 12*b*. An iron core 12*c* is secured to the substantially U-shaped plate in such a manner that it is disposed between the two side walls of the stator 12. A coil bobbin 15*a* is placed over the iron core 12*c*, and an exciting coil 15 is wound on the coil bobbin.

The width of each of the magnetic poles 12*a* and 12*b* is set to $90° = (\beta)$ in angle.

The rotor 13 is made of a magnetic material, and is magnetized so that its peripheral portions on a diametral line have the same polarity as shown in FIG. 5. The distance between the N and S poles thus magnetized is $2\alpha$ in angle as shown in FIG. 4. More specifically, the magnetizing angle $\alpha$ is set to 30 degrees symmetrically with respect to the line connecting the center points P and Q ($\alpha = 30°$). A pin 13*a* is embedded in one side face of the rotor 13.

The aforementioned intermittent drive transmission device 3, as shown in FIGS. 1 through 3 and 6, has a cut disk member 31, a ratchet plate member 32, and a ratchet pawl 34 which is rotatably connected to the cut disk member 31 by a supporting shaft 33. The cut disk member 31 is supported on the substrates 11*a* and 11*b* through a shaft 35. The cut end of the cut disk member 31 will be referred to as a cut section 31*a*. In the cut disk member 31, an elongated slot 31*b* extending towards the center from the circumference of the cut disk member is provided symmetrically with the cut section 31*a*. The pawl top 34*a* of the ratchet pawl 34 abuts against one of the ratchet teeth of the ratchet plate member 32 by the elastic force of a thin leaf spring 36 having one end secured to a protrusion 31*c* on the cut disk member 31. More specifically, the end of the thin leaf spring 36, as shown in FIG. 3, is fixedly inserted into a groove cut in the protrusion 31*c*. This method is advantageous in that the leaf spring is never removed from the protrusion during the operation or work and it is unnecessary to use a particular bonding agent. Of course, the leaf spring may be secured to the cut disk member by other methods. The ratchet pawl may be depressed by the use of a thin spring. The pin 13*a* embedded in the rotor 13 is arranged so that it can slide into the elongated slot 31*b*.

If the outside diameter of the cut disk member 31 and the position of the supporting shaft 33 are set to meet a condition $a/b > 1$ (where a is the distance between the center of the cut disk member 31 and the position of the pin 13*a* obtained when the pin 13*a* is slid most deeply into the elongated slot, and b is the distance between the center of the cut disk member 31 and the pawl top of the ratchet pawl 34), then the driving force of the rotor 13 can be amplified by a/b times. Hence the force of driving a train of wheels including the ratchet plate member 32 can be increased as much. A relief section A is provided on one side wall, near the opening, of the elongated slot 31*b*.

As a result, when the pin 13*a* is returned with the self-return of the rotor 13, the cut disk member 31 is not turned excessively clockwise, and therefore the operation angle of the cut disk member 31 is stable. When the pin 13*a* passes through the position of the relief section A, the rotor 13 is about to stop itself by self-returning between the magnetic poles of the stator, and therefore it may cause vibration. Even if the rotor is vibrated, the vibration is not transmitted to the cut disk member because of the relief section A. Furthermore, the noise which may otherwise be caused can be eliminated. The configuration of the relief section A can be determined from the locus of the pin 13*a*.

Figure 7:
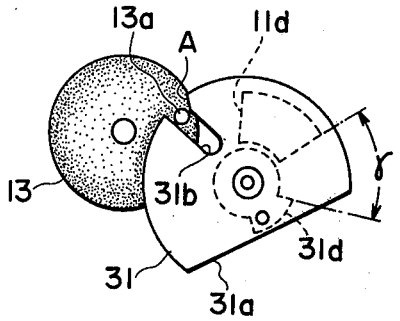

A stopper 31*d* is provided at the central portion of the lower surface of the cut disk member 31 as shown in FIG. 7, and a land sector 11*d* is provided on the substrate 11*a*. The position of the stopper 31*d* is to control the rotation angle $\gamma$ of the rotor 13 as will be described herein. The noise which is caused when the land sector 11*d* is struck can be reduced by providing the stopper near the center of the cut disk member. The stopper may be provided on the lower surface of the rotor 13.

Figure 8:
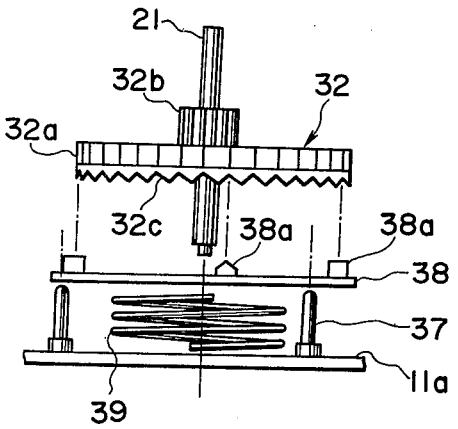
FIG. 8 is a side view of a ratchet plate member.

As shown in FIG. 8, the ratchet plate member 32 is secured to a minute shaft 21 which is rotatably supported on the substrates 11*a* and 11*b*. The ratchet plate member has ratchet teeth 32*a* around its periphery. A pinion 32*b* is fixedly secured to the upper surface of the ratchet plate member, and a detent section 32*c* formed with a number of triangular members is provided on the lower surface of the ratchet plate member. In the embodiment shown, the number of triangular members is sixty (60), and the pitch ratio of the ratchet teeth and the detent section is 1:1. The top of the ratchet pawl 34 abuts against the ratchet teeth 32*a*, so that the ratchet plate member is driven intermittently. The pinion 32*b*, as shown in FIG. 2, is engaged with a day rear gear 22 in the time piece mechanism 2.

A stopper plate 38 is held vertically slidably with a plurality of posts 37, and a coil spring 39 is disposed below the ratchet plate member 32. Instead of the coil spring 39, a leaf spring may be used. A plurality of triangular detents 38*a* are provided on the stopper plate 38. There are three triangular detents 38*a* shown in FIG. 8. These detents 38*a* are abutted against the detent section 32*c* from below by the elastic force of the coil spring 39.

The time piece mechanism 2, as shown in FIG. 2, constitutes the day rear gear or transmission gear 22 supported on a shaft 23 and an hour needle gear 24 secured to the minute shaft 21. The transmission gear 22 has a gear engaged with the pinion 32*b*, and a pinion 22*a* engaged with the hour needle gear 24. The gear and pinion 22*a* are integral with the transmission gear 22. A boss 24*a* is formed in the upper portion of the hour needle gear 24. The upper end portion of the boss 24*a* together with the upper end portion of the minute shaft 21 protrudes upwardly through a hole in the substrate 11*b*. The peripheral portion of the boss 24*a* and the hole in the substrate 11*b* support the minute shaft rotatably. An hour hand 25 is placed over the boss 24*a* protruded from the substrate 11*b*, and a minute hand 26 is connected to the minute shaft 21. A dial is bonded to the upper surface of the substrate 11*b*, or the time is graduated directly on the substrate.

In an example shown in FIG. 9, a second hand is provided in addition to the hour hand and the minute hand. One revolution of the ratchet plate member 32 is set to equal one minute. A second gear 27 and a third gear 28 are provided between the pinion 32*a* and the day rear gear 22. A pinion 27*a* and a hollow shaft 27*b* are fixedly secured to the upper surface of the second gear 27, the pinion 27*a*, the hollow shaft 27*b* and the second gear forming one unit. The minute hand 26 and the second hand 29 are fixedly fastened to the upper end portions of the hollow shaft 27*b* and the minute shaft 21, respectively.

The reset mechanism for the above described time piece includes a mechanical reset mechanism and an electrical reset mechanism. The mechanical reset mechanism is associated with the gearing of the time piece in order to allow correction of the time indication appearing on the face or dial of the time piece. The electrical reset mechanism includes a reset switch SW which is closed by the mechanical reset mechanism when the latter is operated. The closure of the switch SW serves to reset an integrated circuit of the electric source unit 5, as more fully explained hereafter.

Figure 10A:
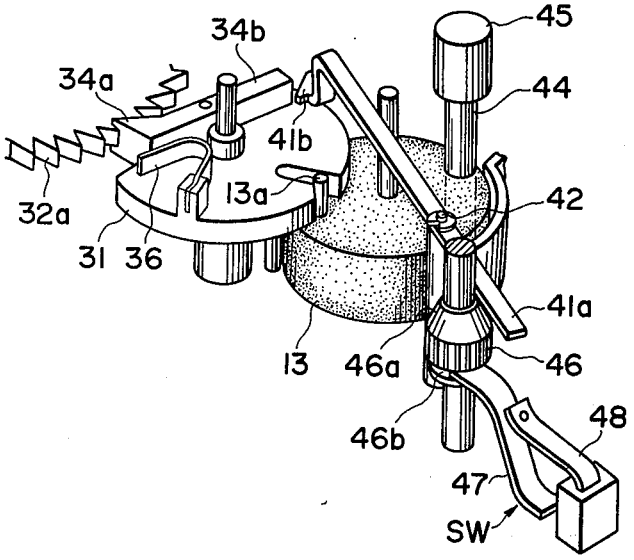
FIGS. 10*a*, 10*b* and 11*a*, 11*b* are diagrams for a description of the operation of a reset mechanism.
Figure 10B:
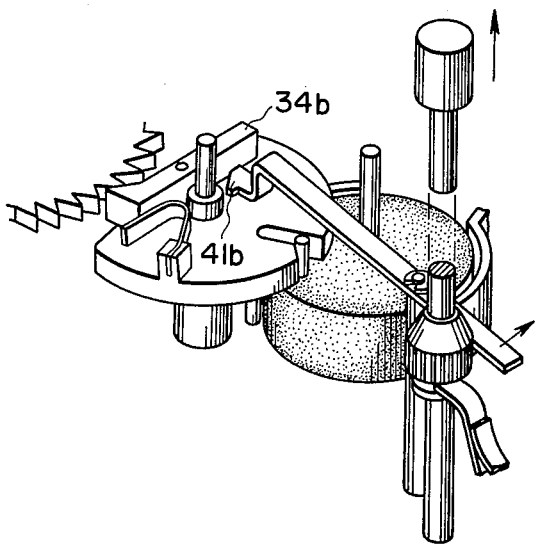
Figure 11A:
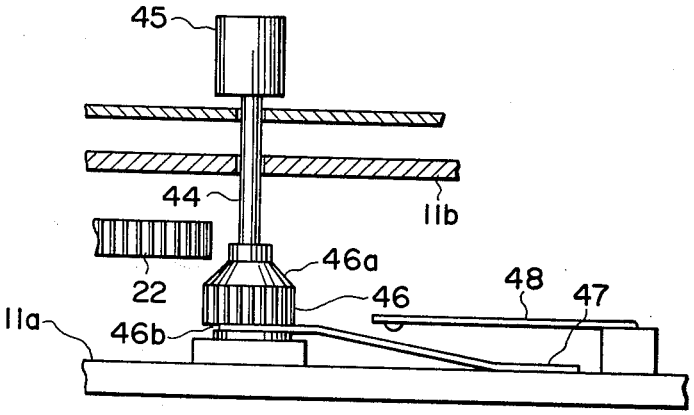
Figure 11B:
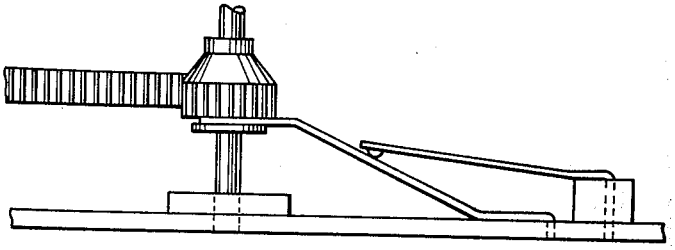
Figure 12:
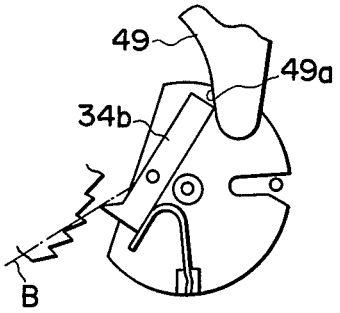
FIG. 12 is an explanatory diagram for a description of a method in which a ratchet pawl is turned by a guide plate.
Figure 14:
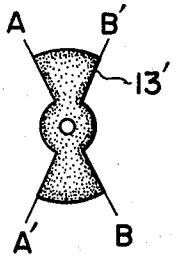
FIG. 14 is a modification of the rotor 13 shown in FIGS. 3–5.

The mechanical reset mechanism (hereinafter referred to simply as "reset mechanism") for the time piece mechanism is shown in FIGS. 1, 10 and 11, and comprises: a release lever 41 adapted to disengage the ratchet pawl 34 from the ratchet teeth 32*a*. A correcting shaft 44 has a knob 45 at the upper end and a correcting gear 46 at the lower end. The reset switch SW is operated by moving the correcting shaft 44 vertically. The release lever 41 is rotatably supported on a supporting shaft 42, and it is normally energized to turn clockwise by means of a spring 43 so that one end portion of the release lever 41 abuts against the correcting shaft 44. The release lever 41 is designed so that the other end portion 41*b* thereof can abut against the other end portion 34*b* of the ratchet pawl 34.

The correcting gear 46 is a pinion having a sloped surface 46*a*. This sloped surface 46*a* facilitates engagement of the correcting gear 46 with the transmission gear 22. Furthermore, the release lever 41 is turned by the sloped surface 46*a* to allow the top 34*a* of the ratchet pawl 34 to disengage from the ratchet tooth 32*a*. An annular groove 46*b* is cut in the shaft 44 below the correcting gear 46. The reset switch SW is made up of two leaf springs 47 and 48, and the end portion of the leaf spring 47 is inserted into the groove 46*b* formed in the shaft 44.

It should be noted that the leaf spring serves also to depress the correcting shaft 44 towards the substrate 11*a*. The other end portions of the two leaf springs 47 and 48 of the reset switch SW are fixedly secured to the substrate 11*a*. When the correcting shaft 44 is lifted with the knob 45, the contact on the end portion of the leaf spring 48 is brought into contact with the leaf spring 47 to thereby close the reset switch SW.

The disengagement of the ratchet pawl 34 from the ratchet tooth 32*a* may be accomplished by providing a guide plate 49 with which the other end portion 34*b* of the ratchet pawl 34 makes slidable contact. In this case, the sliding surface 49*a* of the guide plate 49 is formed so that when the pawl top 34*a* of the ratchet pawl 34 feeds the ratchet teeth 32*a* by one pitch, the guide plate 49 is engaged with the ratchet pawl. When the ratchet pawl 34 is retracted, it is moved along the locus B. The reset mechanism may be designed so that when the correcting knob 45 is depressed, the correcting gear 46 engages the transmission gear 22.

Figure 13:
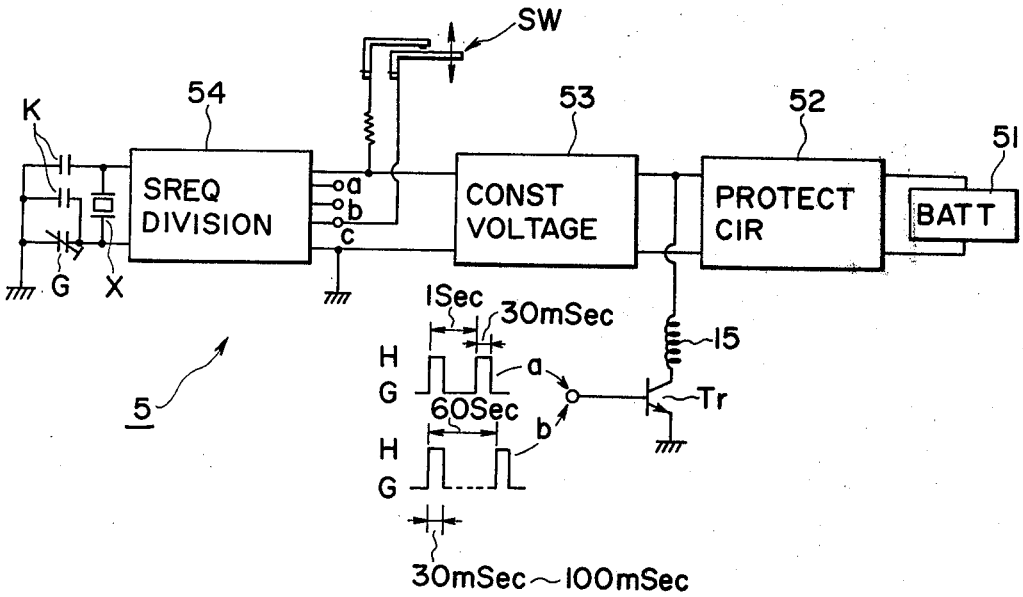
FIG. 13 is an explanatory diagram showing an electric source unit.

FIG. 13 shows the aforementioned electric source unit 5, which is one example of the electrical circuit of an automobile time piece. An automobile battery electric source 51 is connected to a protection circuit 52 which is connected to a constant voltage circuit 53 and to the above-described exciting coil 15. The constant voltage circuit 53 is connected to an oscillation frequency division circuit 54 which may be made up of a plurality of capacitors K and G, a crystal oscillator X and other elements. The oscillation frequency division circuit 54 has terminals a, b and c. The other end of the exciting coil 15 is connected to the collector of a transistor Tr the emitter of which is grounded. The base of the transistor Tr is connected to the terminal a or b.

A DC pulse signal of, for instance, 1 Hz is applied through terminal a to the base of the transistor Tr. Alternatively, a DC pulse signal of, for instance, 1/60 Hz is applied through terminal b to the base of the transistor Tr, so that a pulse current is applied through the transistor Tr to the exciting coil 15. The aforemention switch SW is connected between terminal c and one terminal of the constant voltage circuit 53. It is closed when the time piece is reset. The output signal of 1 Hz is used for an analog time piece which has the second hand, while the output signal of 1/60 Hz is employed for an analog time piece which has no second hand.

The operation of the electrical time piece thus constructed will now be described. First the operating principle of the drive device 1 will be described. When no pulse voltage is applied to the exciting coil 15, as shown in FIG. 5 (*a*) the rotor 13 is fixed by the reluctance torque of the rotor 13. Then, when the pulse voltage is applied to the exciting coil 15 so that the curved magnetic poles 12*a* and 12*b* of the stator 12 and the iron core 12*c* are magnetized to have the S pole and the N pole, respectively, as shown in FIG. 5 (*b*), a rotation force is generated with the rotor 13. That is, the rotor 13 is rotated counterclockwise.

In the case where the rotor 13 is a freely rotatable, upon application of the DC voltage E, the rotor 13 turns to the position indicated in FIG. 5 (*d*) and stops there. When, under this condition, application of the voltage E is suspended, the magnetization of the magnetic poles 12*a* and 12*b* of the stator 12 is eliminated. At the same time, as shown in FIG. 5 (*d*), the S pole of the rotor stops at the position of the iron core 12*c* of the stator 12 owing to the magnetism of the rotor 13. As a result a magnetic loop is formed between the rotor 13 and the stator 12. Accordingly, in this case, no returning force is generated. Therefore, this mode of operation defines a method in which the rotation angle $\gamma$ of the rotor is controlled by providing a stopper in the direction of rotation of the rotor 13. That is, the stopper is disposed so that the rotor is stopped at the position of a rotation angle smaller than that in FIG. 5 (*d*).

Then, after the rotor has been turned, the application of the voltage is suspended. In this case, the magnetic loop is as shown in FIG. 5 (*c*), and the clockwise and counterclockwise rotation forces due to the reluctance torque are balanced, and therefore the rotor is continuously at a reset position. On the other hand, if the position of the stopper is further changed so that the rotor is stopped at a position before that in FIG. 5 (*c*), then the rotor 13 is returned to the position shown in FIG. 5 (*a*) after the elimination of the applied voltage. This will occur because the returning force due to the reluctance torque of the rotor is increased.

Thus, if the pulse current is applied to the exciting coil 15 with the aid of the d.c. pulse voltage of the electric source unit 5 shown in FIG. 11, when the reciprocation or rotation and self-return, of the rotor can be effected in synchronization with the on-off operation of the pulse, without additionaly providing an external returning force. The rotation angle $\gamma$ of the rotor is set to 35 degrees by the stopper 31*d* of the cut disk member 31 and the land sector 11*d* of the substrate.

The reciprocation through the rotation angle $\gamma$ of the rotor 13 causes the pin 13*a* to slide into the elongated slot 31*b*, so that the reciprocation is transmitted to the cut disk member 3 As a result, the cut disk member 3 is turned around the shaft 35. The pawl top 34*a* of the ratchet pawl 34 feeds the ratchet teeth 32*a* one pitch by one pitch riding over the triangular members of the detent sections 32*c* and 38*a*, to turn the ratchet plate member 32.

The rotation of the ratchet plate member 32 turns the second hand 29 or the minute hand 26 directly and also turns the transmission gear 22 or the third gear 28 through the pinion 32*b*. The rotation of the transmission gear 22 causes the hour hand gear 24 to turn through the pinion 22*a* to turn the hour hand 25. When the third gear 28 is turned, its rotation is transmitted through the pinion 28*a* and the second gear 27 to the transmission gear 22, while the minute hand 26 is turned through the hollow shaft 27*b* of the second gear 27.

In the case where the time indication is to be corrected, the knob 45 is pulled upwardly, so that the release lever 41 is turned by the sloped surface 46*a* of the correcting gear 46 and the correcting gear 46 is engaged with the day rear gear 22. When the release lever 41 is turned, the pawl top 34*a* of the ratchet pawl 34 is disengaged from the ratchet tooth 32*a*. On the other hand, when the knob 45 is pulled up, the reset switch SW is closed. As a result, the signal is applied to the reset terminal c of the electric source unit 5 to reset an integrated circuit 54. If, under this condition, the knob 45 is turned manually, then the transmission gear 22 is turned, and the minute indication or hour indication can be corrected.

If, when the time indication has been corrected, the knob 45 is released, the knob 45 is retracted by the elastic force of the leaf spring 47 and simultaneously the reset switch SW is opened, while the correcting gear 46 is disengaged from the transmission gear 22. At the same time, the other end portion 41*b* of the release lever 41 is disengaged from the ratchet pawl 34. Accordingly, the pawl top 34*a* of the ratchet pawl 34, being depressed by the leaf spring 36, is engaged with the ratchet tooth 32*a*. Thus, the reciprocation of the drive device 1 is transmitted, as an intermittent motion, to the transmission gear 22 through the cut disk member 31 and the ratchet plate member 32. Hence the minute hand 26 and the hour hand 25 are operated to indicate time.

This invention has been described with respect to the analog time piece; however, the technical concept of the invention may be applied to the digital time piece.

Because the time piece has been arranged as described above according to the invention, the size of the driving source is markedly reduced. Even if the time piece is vibrated there is no force produced to rotate the rotor, for instance, with the returning spring bent. The rotor is well-balanced, that is, its center of gravity is the center of rotation, and it is maintained at rest at the predetermined position owing to the reluctance torque. Therefore, the time piece can withstand considerable vibration. Thus, the electrical time piece free from vibration can be provided according to the invention. Also because the number of gear trains is small, the size of the time piece according to the invention is accordingly very small. Furthermore, since the drive device used is excellent in response characteristic, its power consumption is also very small. It is apparent that modifications can be made to this invention without departing from the essential scope thereof.

Figure 15:
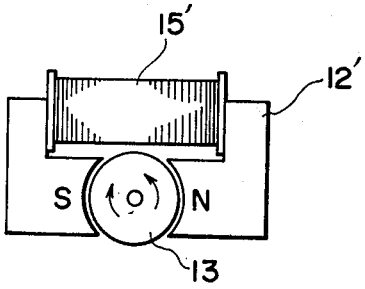
FIGS. 15 and 16*a*, 16*b*, 16*c* show various modifications of the swing motor.

For example, the swing rotor 13 may be modified as shown in FIG. 15. So long as the effective distance of the magnetization angle $2\alpha$ is maintained, the rotor may take the form of the "bow-tie" configuration as shown rotated about the center point. The portions forming the side walls are defined by the lines A-B and A'-B' corresponding to FIG. 4.

Figure 16A:
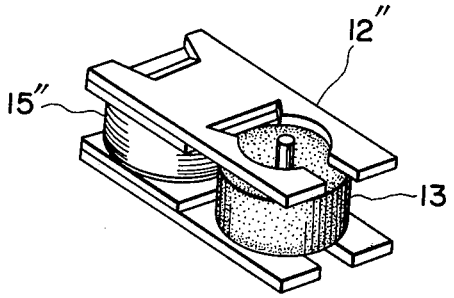
Figure 16B:
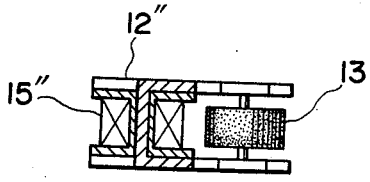
Figure 16C:
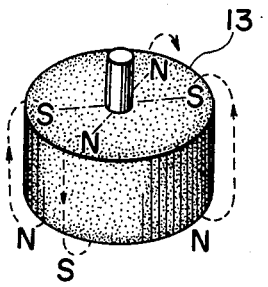

FIGS. 15 and 16 show two modifications of the swing motor. FIG. 15 shows a case where the stator 12' is disposed at an orientation shifted 90° from that shown in FIGS. 1, 3, 4 and 5 with the iron core 12 (*c*) deleted. The exciting coil is coupled directly to the magnetic poles as shown.

FIG. 16(*a*) shows a perspective view of another modification with FIG. 16 (*b*) showing a cut-away side view and FIG. 16 (*c*) showing the rotor 13 and the magnetic loops formed therein. In FIG. 16, the stator 12'' is desposed over the top and bottom faces of rotor 13, that is, it is shifted 90° from that previously shown so that it does not encompass the periphery of the rotor. Cutaway portions shown in FIGS. 16(*a*), 16(*b*) and 16(*c*) form the appropriate loops with the magnetized portions of the rotor and the stator coupled to sides of the exciter 15''. In both cases, FIGS. 15 and 16, operation is similar to that described for FIG. 5.

What is claimed is:

1. An electrical swing device comprising: drive means having a rotor and a stator, said drive means effectuating self-returning reciprocation within the rotation angle of said rotor, said self-returning reciprocation being effected by the reluctance torque of said rotor; intermittent drive transmission means for transmitting the rotation of said drive means to a utilization mechanism; a mechanical reset mechanism associated with said utilization mechanism; and means for exciting said stator with a pulse current.

2. An electrical swing device as claimed in claim 1, in which said rotor is magnetized such that like poles are formed on a diametral line intersecting the rotation axis thereof, and the magnetization angle between opposite poles is $2\alpha$, said stator having a magnetic pole angle $\beta$ which is larger than said magnetization angle $2\alpha$.

3. The electrical swing device of claim 2 wherein said rotor is a disk.

4. The electrical swing device of claim 2 wherein said rotor is configured in a bow-tie orientation having side walls defining said magnetization angle $2\alpha$.

5. An electrical swing device as claimed in claim 1, in which said intermittent drive transmission means comprises: a cut disk member having a ratchet pawl, said disk member reciprocated by said drive means, and a ratchet plate member being having ratchet teeth which are moved pitch by pitch by said ratchet pawl.

6. An electrical swing device as claimed in claim 5, in which said rotor is provided with a pin, and said cut disk member is provided with an elongate slot slidably engaging said pin.

7. An electrical swing device as claimed in claim 6, further comprising a relief section provided on one side of the opening of said elongated slot.

8. An electrical swing device as claimed in claim 5, further comprising a substrate, a stop provided on said cut disk member and a protruding land sector provided on said substrate, whereby the rotation angle of said rotor is set to a value $\gamma$.

9. An electrical swing device as claimed in claim 5, wherein a distance (a) between the rotation center of said cut disk member and said pin slid into said elongated slot in said cut disk member and a distance (b) between said rotation center and the top of said ratchet pawl are defined by the following expression: $a/b > 1$.

10. An electrical swing device as claimed in claim 5, further comprising a stop plate provided below said ratchet plate member, and detent sections provided on the lower surface of said rachet plate member and on the upper surface of said stop plate, respectively, said detent sections engaging each other.

11. An electrical swing device as claimed in claims 5 or 10, in which a pitch ratio of said ratchet teeth and the detents of said detent section of said ratchet plate member is 1:1.

12. An electrical time piece as claimed in claim 5, wherein said mechanical reset mechanism comprises: a release lever for disengaging said ratchet pawl from said ratchet tooth; a correcting gear with a sloped surface for turning said release lever, said correcting gear engaging a rear gear, a correcting shaft to which said correcting gear is fixedly secured, said correcting shaft being slidably moved vertically; and wherein an electrical reset mechanism includes a reset switch operated by vertically moving said correcting gear.

13. An electrical swing device as claimed in claim 12, wherein said reset switch is connected to said exciting means, said reset switch comprising a pair of leaf springs.

14. An electrical swing device as claimed in claim 1, wherein said utilization mechanism is a time piece.

15. An electrical swing device as claimed in claim 12, wherein said utilization mechanism is a time piece and said rear gear is a day rear gear of said time piece.

* * * * *